US005505298A

United States Patent [19]

Dlugopolski

[11] Patent Number: 5,505,298

[45] Date of Patent: Apr. 9, 1996

[54] GARMENT BAG BOX

[75] Inventor: Joseph J. Dlugopolski, Lombard, Ill.

[73] Assignee: Fidelity Container Corp., Elk Grove, Ill.

[21] Appl. No.: 391,638

[22] Filed: Feb. 21, 1995

Related U.S. Application Data

[63] Continuation of Ser. No. 229,643, Apr. 19, 1994, abandoned, which is a continuation-in-part of Ser. No. 166,578, Dec. 13, 1993, abandoned.

[51] Int. Cl.[6] ..... B65D 85/18

[52] U.S. Cl. ..... 206/279; 229/138; 206/294

[58] Field of Search ..... 206/279, 294, 206/297; 229/117.18, 137, 138, 148, 154, 213, 117.14

[56] References Cited

U.S. PATENT DOCUMENTS

| | | | |
|---|---|---|---|
| 1,763,025 | 6/1930 | Van Wormer | 229/138 X |
| 2,025,477 | 12/1935 | Scott | 229/138 X |
| 2,047,891 | 7/1936 | Scott | 229/138 X |
| 2,087,940 | 7/1937 | Scott | 229/138 X |
| 2,292,653 | 8/1942 | Palmer | 229/138 X |
| 2,470,199 | 5/1949 | Vivian | 229/213 |
| 2,500,641 | 3/1950 | Mali et al. | 229/141 X |
| 3,032,176 | 5/1962 | Humphrey | 206/279 |
| 3,071,305 | 1/1963 | Zinn | 229/117.18 |
| 3,866,750 | 2/1975 | Collin | 229/190 X |
| 4,010,888 | 3/1977 | Gilbert | 229/117.14 X |
| 4,678,079 | 7/1987 | Henning | 206/289 X |
| 4,678,882 | 7/1987 | Bohrer et al. | 229/148 X |
| 4,944,395 | 7/1990 | Coursen | 206/289 X |
| 5,058,740 | 10/1991 | Coursen | 229/110 X |
| 5,230,463 | 7/1993 | Brauner | 229/138 |

*Primary Examiner*—Allan N. Shoap
*Assistant Examiner*—Christopher J. McDonald
*Attorney, Agent, or Firm*—Laff, Whitesel, Conte & Saret, Ltd.

[57] ABSTRACT

A box suitable for holding a garment bag or for clothes hung on hangers during travel includes front and rear panels, two side panels, a bottom, and a top. The top is constructed from panels folded to form a peak and gables. The top includes a slot allowing passage of the neck of a hanging hook of a garment bag or of clothes hangers to protrude out from the box, and a hole spaced from the slot allowing re-entry of the end of the hanging hook or hanger. When the hanging hook or hanger are properly installed, the garment bag or clothes hangers are securely suspended in the box. The box shape reduces the possibility of becoming snagged in a baggage conveyor.

8 Claims, 7 Drawing Sheets

GARMENT BAG BOX

This application is a continuation, of application Ser. No. 08/229,643, filed Apr. 19, 1994, now abandoned, which is a continuation-in-part application to U.S. patent application Ser. No. 08/166,578, filed Dec. 13, 1993, now abandoned.

This invention relates to packaging, cartons, boxes and the like. More particularly, this invention relates to boxes for garment bags.

BACKGROUND

Garment bags are frequently used forms of luggage, particularly favored by business travelers who travel by air or train. When garment bags are checked with an airline, they are often protected from damage by a box or carton which is generally rectangular in cross section and sufficient in length to accommodate the garment bag. Because this long box is awkward to handle, it is customary to include as part of the box a handle portion at one end of the box.

One style of handle currently used consists of a pair of mating handle flaps extending longitudinally from the top end of the box. The flaps have mating holes in them sufficiently large for the fingers or a hand to slip through. When assembled together, the handle flaps form a generally flat handle which can be grasped by slipping the fingers or a hand through the mating holes and curling the fingers around the two assembled flaps.

This structure, and similar structures for garment bag boxes, create problems when they are placed on the conveyer system in an airline's baggage handling area. The projecting handle acts like a hook and tends to get caught on the conveyor mechanism. This often causes the handle to tear, rendering it useless and requiring a temporary shutdown of the baggage conveyor to extricate the box. This in turn causes delays in distributing luggage to the passengers.

Accordingly, an object of this invention is to provide a box which can easily receive and safely protect a garment bag. Another object is to provide a box that can be easily and reliably grasped and carried after the garment bag is loaded into the box, and which securely suspends the garment bag within the box despite the jostling that occurs during travel. Yet another object is to provide such a box that will avoid becoming caught and tearing on the conveyor system in a baggage area of a common carrier.

SUMMARY OF THE INVENTION

In keeping with an aspect of the invention, these and other objects are accomplished by a box which holds the garment bag or clothes hangers and allows passage of and engages the hanging hook of the garment bag or the hangers. In one embodiment, the top of the box is a hip roof peaked and gabled in four sides to present smooth surfaces and no protruding handles to catch on a conveyor system. The box is carried or grasped with a slot formed in a rear panel of the box.

BRIEF DESCRIPTION OF THE DRAWINGS

The above-mentioned and other features of the invention will become more apparent and the invention itself will be best understood by reference to the following description of embodiments of the invention taken in conjunction with the accompanying drawings, in which.

DETAILED DESCRIPTION OF THE PREFERRED EMBODIMENT

Figure 1:
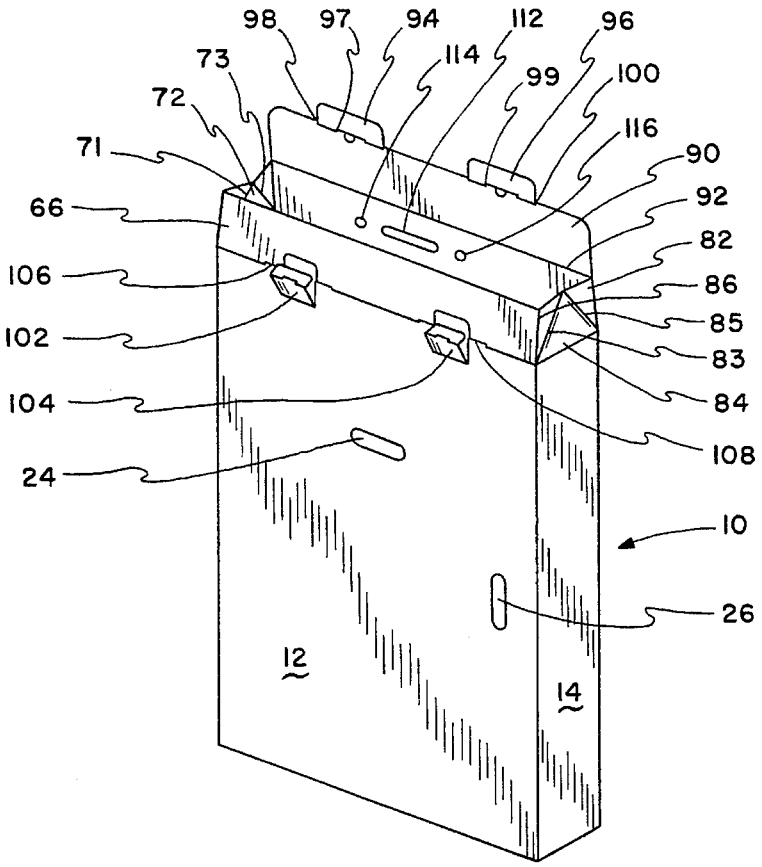
FIG. 1 is a rear perspective view of the invention, with the top open.
Figure 2:
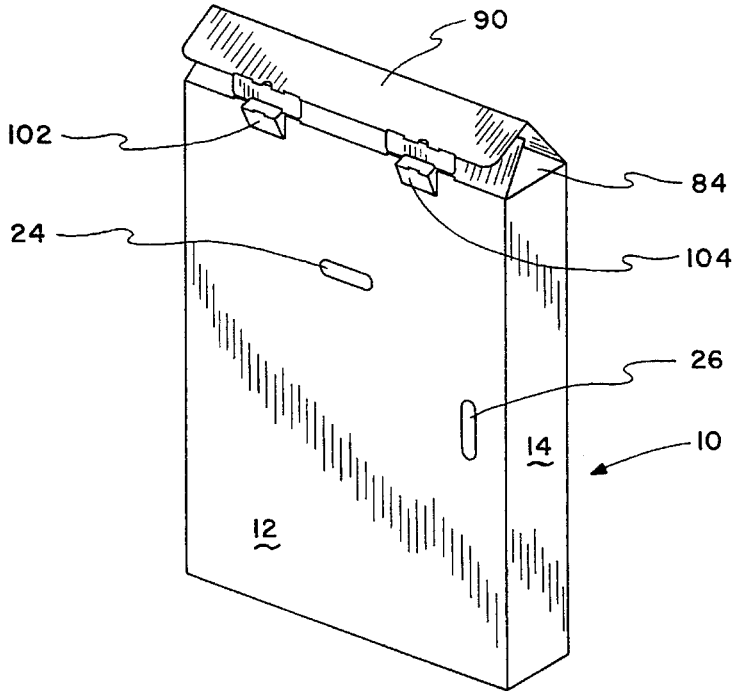
FIG. 2 is a rear perspective view of the invention with the top mostly closed.
Figure 3:
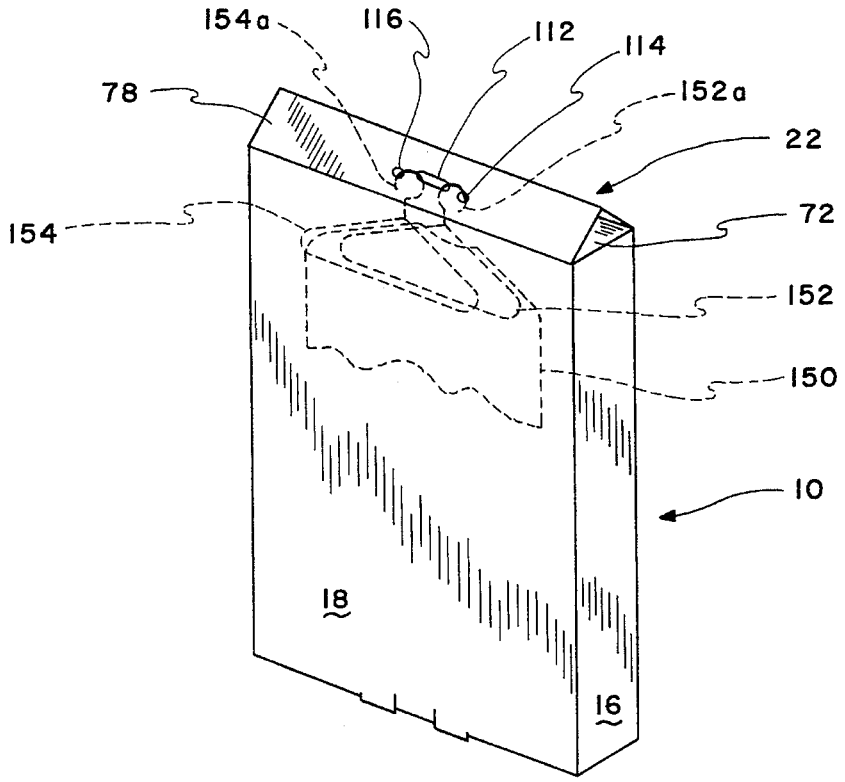
FIG. 3 is a front perspective view of the invention fully assembled and with hangers and a garment bag contained in the invention shown partially in section and in dotted lines.
Figure 4:
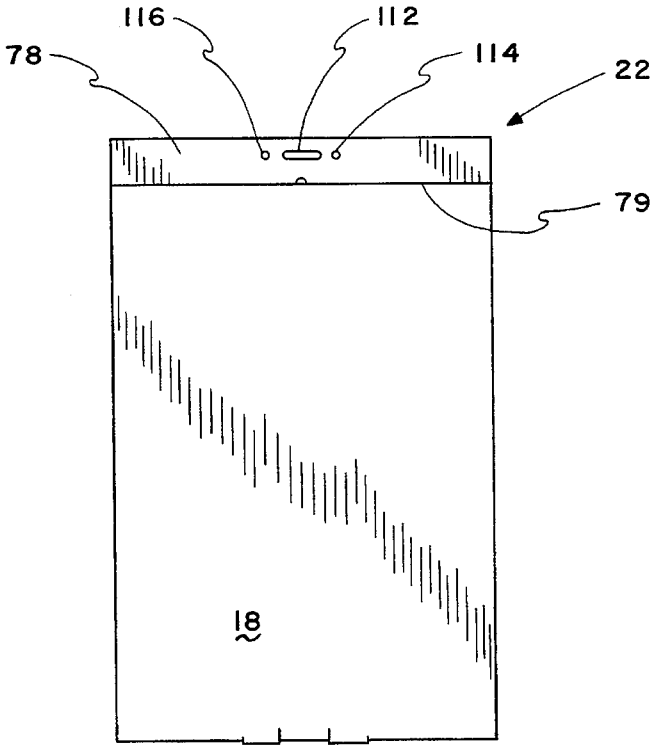
FIG. 4 is a front elevation view of the invention.
Figure 5:
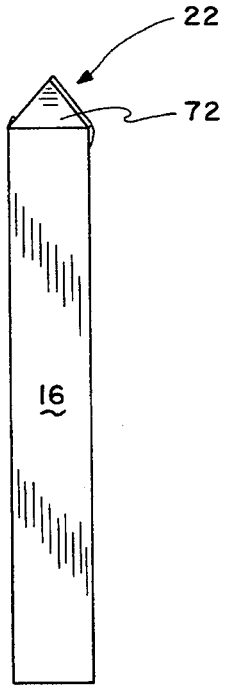
FIG. 5 is a left side elevation view of the invention.
Figure 6:
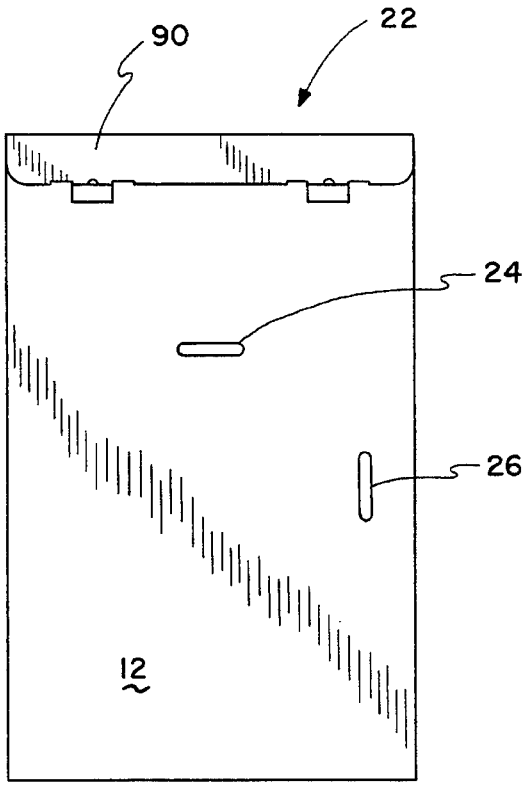
FIG. 6 is a rear elevation view of the invention.
Figure 7:
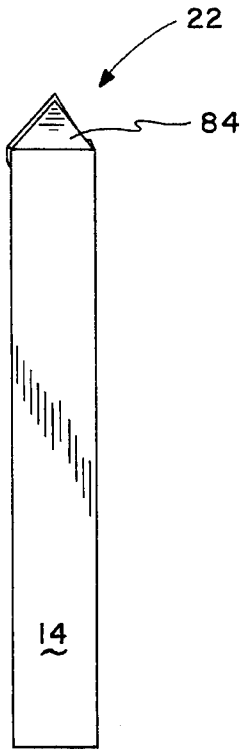
FIG. 7 is a right side elevation view of the invention.
Figure 8:
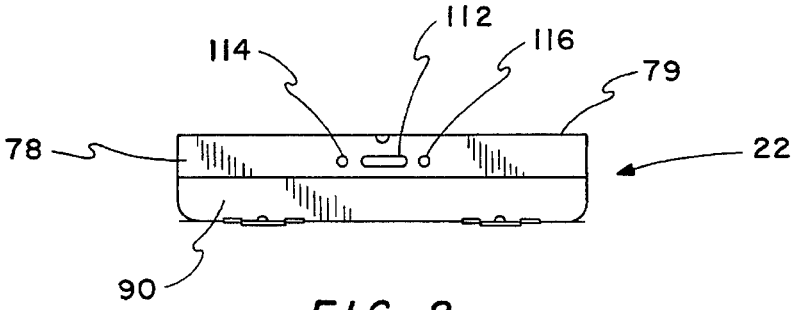
FIG. 8 is a top plan view of the invention.

As shown in FIGS. 1–9, a box for a garment bag is generally shown as 10. The box 10 has a rear panel 12, right and left side panels 14, 16, and a front panel 18. The bottom and top of the box are shown generally as 20 and 22, respectively. Rear panel 12 preferably includes two oblong shaped, hand-sized apertures 24, 26. Aperture 24 extends laterally in rear panel 12, allowing the box to be easily carried with its longitudinal dimension perpendicular to the ground. Aperture 26 extends longitudinally in rear panel 12, allowing the box to be easily carried with its longitudinal dimension parallel to the ground. That portion of rear panel 12 which is cut to form apertures 24, 26 can be either removed entirely, or cut only partially so that a flange of box material remains, thereby allowing the box material to be folded into the box to reinforce the apertures as carrying means.

Figure 10:
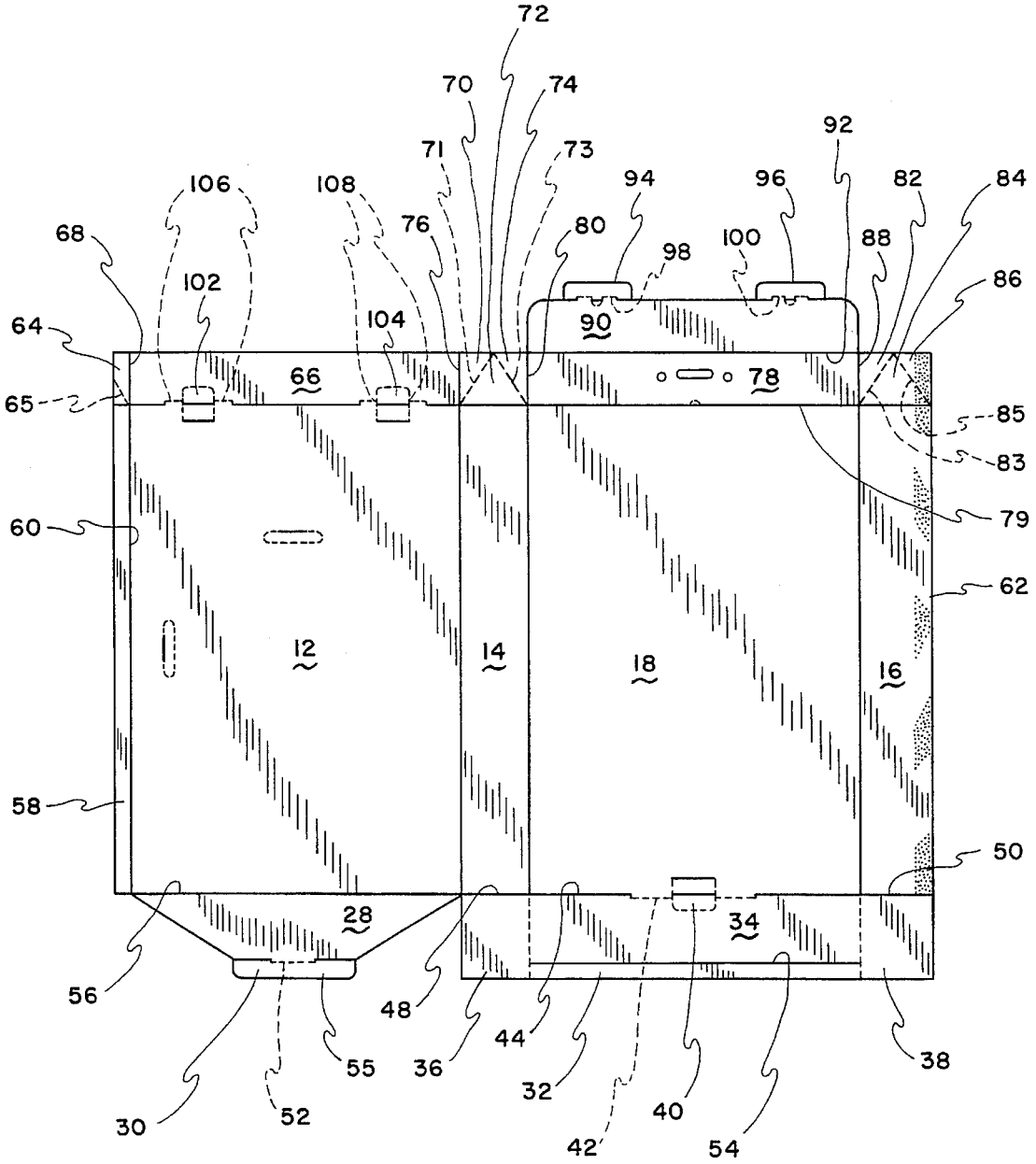
FIG. 10 shows the blank for the invention.

FIG. 10 shows the blank from which the box is constructed. Bottom 20 is formed from trapezoid-shaped panel 28, bottom locking tabs 30, 32, bottom panel 34, and bottom flaps 36, 38. Trapezoid-shaped panel 28 borders rear panel 12 along fold line 56. Bottom panel 34 borders front panel 18 along fold line 44. Bottom flaps 36, 38 border left and right side panels 14, 16, respectively, along fold lines 48, 50 respectively. First keeper slot 52 extends part way along fold line 55 between trapezoid-shaped panel 28 and locking tab 30. Slots formed in the box by line piercing, such as by a rule die, are shown in the drawing by dashed lines. Thus, slot 52 is merely a pierced line in the box material. Bottom locking tab 40 is formed partially in front panel 18 and partially in bottom panel 34, with a second keeper slot 42 extending along part of fold line 44 between front panel 18 and bottom panel 34.

Figure 9:
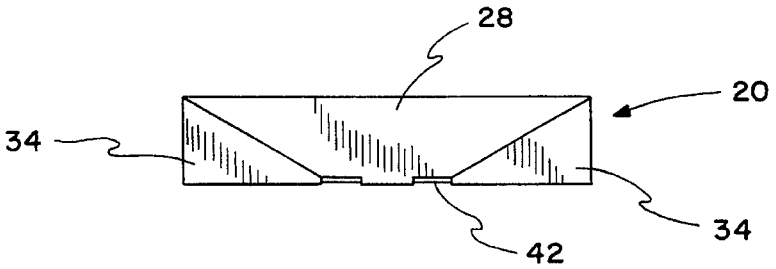
FIG. 9 is a bottom plan view of the invention.

Referring to FIGS. 9 and 10, the bottom 20 is formed by folding bottom flaps 36, 38 inwardly and perpendicularly to side panels 16, 14, respectively, along fold lines 48, 50. Bottom panel 34 is then folded inwardly and perpendicularly to front panel 18 along fold line 44 so that bottom panel 34 overlays bottom flaps 36, 38. Bottom locking tab 32 is folded along fold line 54 upwardly and perpendicularly to bottom panel 34. Trapezoid panel 28 is folded inwardly and perpendicularly to rear panel 12 along fold line 56 so that it overlays bottom panel 34. Locking tab 30 is folded upwardly and perpendicularly to trapezoid panel 28 and into keeper slot 42. Bottom locking tab 40 can then be inserted into second keeper slot 52. The bottom is then fully assembled, as best shown in FIG. 9. By disengaging the locking tab 40, the bottom can be opened if desired and re-closed later.

The box is assembled along its side by folding side flap 58 inwardly and perpendicularly to rear panel 12 along fold line 60, and then gluing side flap 58 to the inside surface 62 of side panel 14. The glue is shaded in FIG. 10.

Referring to FIGS. 1, 2, 8 and 10, the top 22 of the box is assembled into a peak with gable ends slightly recessed under the peak. The top 22 includes a top flap 64 bordering first top panel 66 along fold line 68. First top panel 66 borders a first set of triangle-shaped panels 70, 72, 74 along fold line 76. The three triangle panels are themselves divided by fold lines 71, 73 which are preferably semi-pierced lines (also shown as dashed lines) where the piercing occurs at spaced locations along the fold lines 71, 73. Top flap 64 is also preferably semi-pierced along fold line 65. First set of triangle-shaped panels 70, 72, 74 border second top panel 78 along fold line 80. Second top panel 78 borders front panel 18 along fold line 79, and it also borders second set of triangle shaped panels 82, 84, 86. The second set are themselves divided by fold lines 83, 85 which are preferably semi-pierced lines.

Top 22 further includes third top panel 90 bordering second top panel 78 along fold line 92. Another pair of locking tabs 94, 96 border third top panel 90 along fold lines 98, 100 respectively. Another pair of keeper slots 97, 99 are formed along fold lines 98, 100 on either side of tabs 94, 96. Yet another pair of locking tabs 102, 104 are formed partially in rear panel 12 and partially in first top panel 66. Keeper slots 106, 108 are formed on either side of locking tabs 102, 104 along fold line 110. Second top panel 78 includes a hanger slot 112 oriented perpendicular to the longitudinal dimension of box 10 and a pair of hanger holes 114, 116, one on either side of slot 112.

To assemble top 22, top flap 64 is preferably glued to the inside surface of triangle panel 86. Once the top flap 64 is glued, a garment bag of the type having a external hanging hook or internal hangers with the hanger necks and hooks protruding out of the bag can be installed in the box. For purposes here, a garment bag 150 having internal hangers 152, 154 are shown in dashed lines in FIG. 3, but other types of garment bags, or even hangers without garment bags, could be stored in the inventive box. The hangers 152, 154 are oriented up toward the top of the box, for reasons that will become apparent.

Triangle panels 82, 86 and 70, 74 are folded outwardly along fold lines 83, 85 and 71, 73, respectively. Folding triangle panels 82 and 74 outwardly causes second top panel 78 to fold inwardly along fold line 79. Folding triangle panels 86 and 70 outwardly causes first top panel 66 to also fold inwardly along fold line 110, because the top flap 64 is glued to triangle panel 86. This causes first and second top panels 66, 78 to angle toward each other and adjoin at their tops i.e., at fold line 92. The hangers 152, 154 are positioned so that their hook ends **152*a*, 154*a* protrude through slot 112 and engage hanger holes 114, 116, respectively, which are spaced appropriately from slot 112 to receive the ends of the protruding hangers or hanging hook. This locks the hangers and garment bag 150 into place within box 10**.

Third top panel 90 is then folded downwardly along fold line 92 so that it overlays first top panel 66 parallel thereto. The three top panels form a peak or gable-shaped top for the box. Third top panel 90 is locked in place by inserting locking tabs 94, 96 into keeper slots 106, 108 respectively, and by inserting locking tabs 102, 104 into keeper slots 97, 99 respectively. The top of the box is then locked in place, with second and third top panels 78, 90 forming an angle between them of less than 180° and preferably about 90° .

A second embodiment of the invention featuring a hip roof which is slanting on four sides is shown in FIGS. 11–19. This embodiment differs only in the construction and assembly of the top. Thus, box 201 includes a rear panel 211, right and left side panels 213, 215, and a front panel 217. Box 201 also includes a bottom shown generally as 119 (FIG. 19), which in turn is formed from trapezoid-shaped panel 127 and bottom panel 133. The bottom is assembled with tabs and keeper slots exactly as described in connection with the first embodiment.

The top of box 201, generally referred to by reference numeral 122, is best viewed in FIGS. 11–13 and 18. Top 122 includes a first trapezoid-shaped top panel 124 which borders a first set of triangle-shaped panels 126, 128, 130, 132, and 134 along a fold line 136 located on one longitudinal end of the first top panel 124. The five triangle panels are themselves divided by fold lines 138, 140, 142, and 144 which are preferably semi-pierced. First set of triangle-shaped panels 126, 128, 130, 132, 134 border a second trapezoid-shaped top panel 146 along a fold line 148 located at a longitudinal end of second top panel 146. Second top panel 146 borders a second set of triangle-shaped panels 156, 158, 160, 162 along fold line 164 located on the other longitudinal end of the second top panel. As with the first set of triangle panels, the second set of triangle panels is divided by fold lines 166, 168, and 170 which are also preferably semi-pierced lines. Referring back to top panel 124, a single triangle panel 172 is located on the opposite end of first top panel 124 from fold line 136 along a fold line 174 at the other longitudinal end of first top panel 124. A top flap 176 borders single triangle panel 172 along fold line 175, and flap 176 includes a fold line 178 which coincides with fold line 170 between triangle-shaped panels 160 and 162.

Both first and second sets of triangle-shaped panels are attached to a pair of fastening tabs 180, 182 and 184, 186, respectively, which engage the inner surfaces 188 (FIG. 12) of first and second top panels. This engagement securely positions the triangle-shaped panels at the end of the gable. Fastening tabs 180 and 182 are joined to adjacent triangle-shaped panels 128 and 132, respectively, along fold line 190. Likewise, fastening tabs 184 and 186 are joined to adjacent triangle-shaped panels 158 and 162, respectively, along fold line 192. Fastening tabs 180, 182 include rounded inner edges 194, and fastening tabs 184, 186 include rounded inner edges 196 to facilitate assembly of the box.

Top 122 further includes a third trapezoid-shaped top panel 198 which borders second top panel 146 along fold line 206. Above third top panel are locking tabs 199 and 200.

Third top panel 198 extends across second top panel 146 from fold line 148 to fold line 164.

Figure 11:
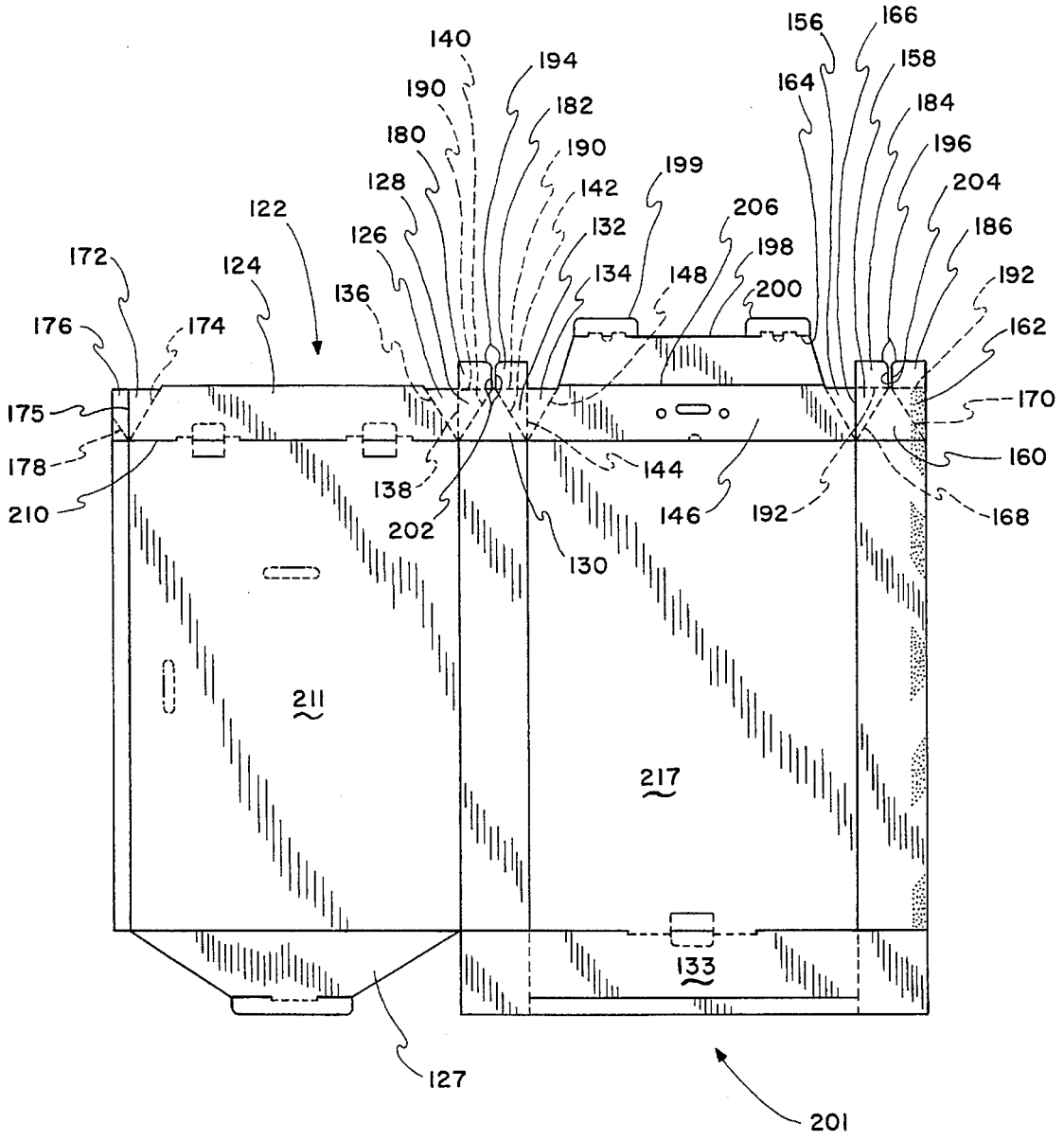
FIG. 11 shows the blank for a second embodiment of the invention featuring a hip roof with four slanting surfaces on both sides and both ends.

As shown in FIG. 11, top 122 of the box is assembled by gluing top flap 176 to the inside surface of triangle-shaped panel 162 so that fold line 178 of top flap 176 coincides with fold line 170 between panels 160 and 162. After the top flap 176 has been glued, a garment bag can be positioned within the box in a manner similar to that described in relation to the previous embodiment. Subsequently, triangle-shaped panels 126, 128 and 132, 134 are folded inwardly along fold lines 138 and 144, respectively. Likewise, triangle-shaped panels 156, 158 and 162, 172 are folded inwardly along fold lines 168 and 174, respectively.

Figure 12:
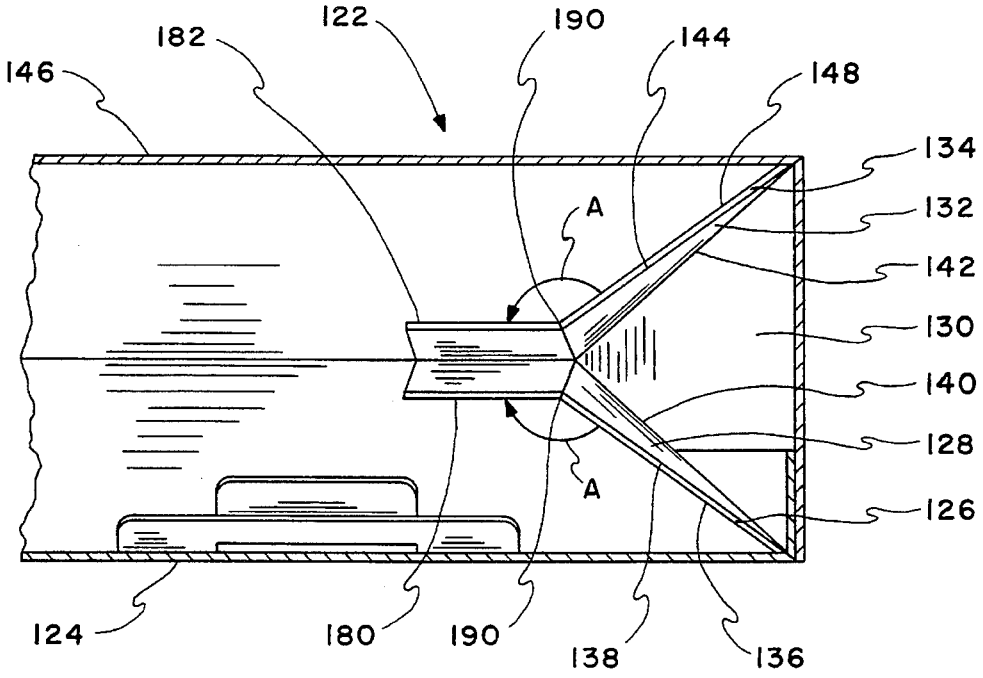
FIG. 12 is a cross sectional view of the embodiment of FIG. 11 taken along line 12—12 of FIG. 13.
Figure 14:
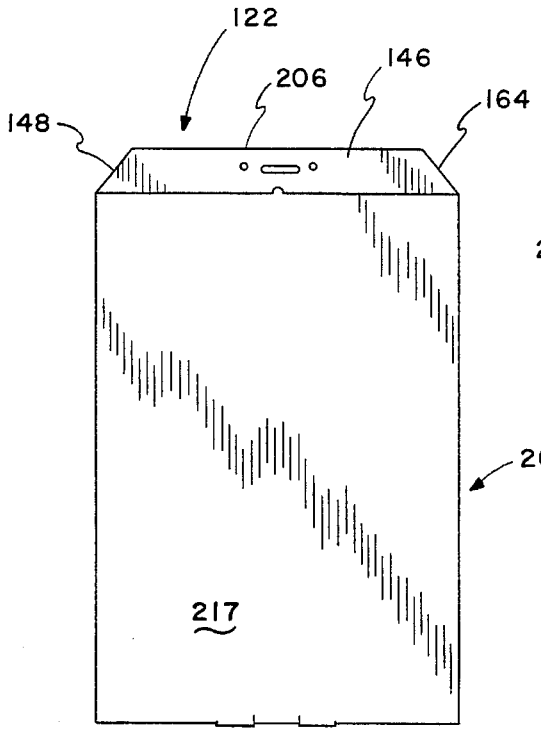
FIG. 14 is a front elevation view of the embodiment of FIG. 11.
Figure 15:
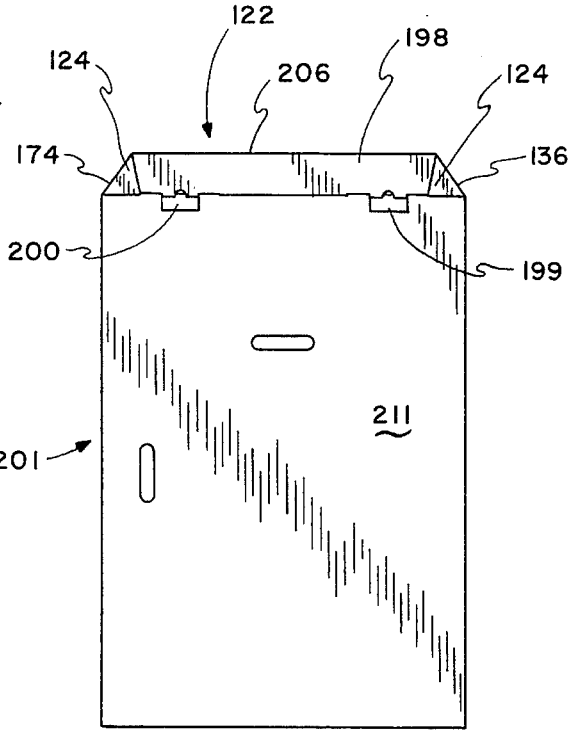
FIG. 15 is a rear elevation view of the embodiment of FIG. 11.
Figure 16:
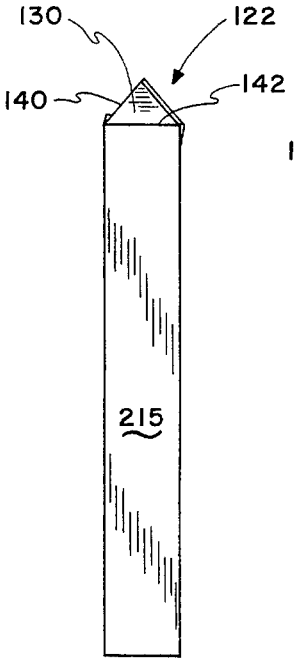
FIG. 16 is a left side elevation view of the embodiment of FIG. 11.
Figure 17:
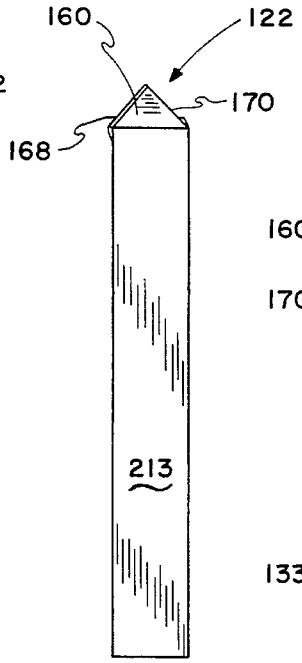
FIG. 17 is a right side elevation view of the embodiment of FIG. 11.
Figure 18:
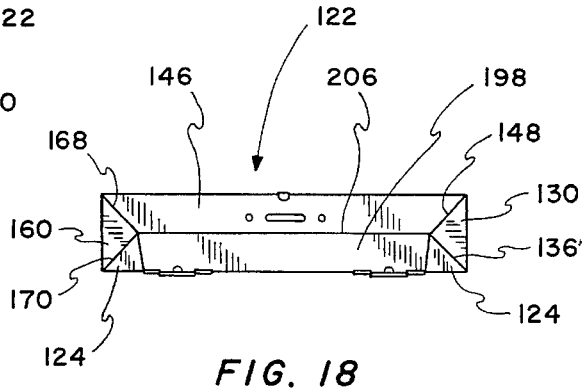
FIG. 18 is a top plan view of the embodiment of FIG. 11.
Figure 19:
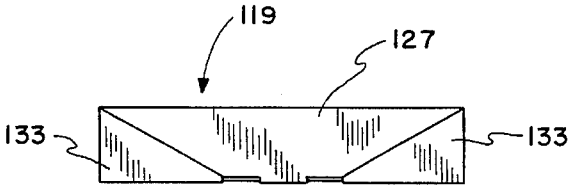
FIG. 19 is a bottom plan view of the embodiment of FIG. 11.

Folding the triangle-shaped panels inwardly causes first and second top panels 124 and 146 to fold inwardly along fold lines 179 and 210 until they adjoin at their tops. In addition, folding the triangle-shaped panels inwardly causes adjacent fastening tabs 180, 182 and 184,186 to also fold inwardly along fold lines 190 and 192 (FIG. 12). This causes fastening tabs 180, 182 and 184, 186 to angle toward each other until they adjoin along their longitudinal edges and form obtuse angles A with the triangle-shaped panels to which they are attached. In this position, the fastening tabs perpendicularly engage the adjoined tops of first and second top panels 124, 146 along edges 202 and 204 of the tabs. Rounded inner edges 194 and 196 of the fastening tabs prevent the tabs from catching on the first and second top panels as they are folded inwardly during assembly.

Figure 13:
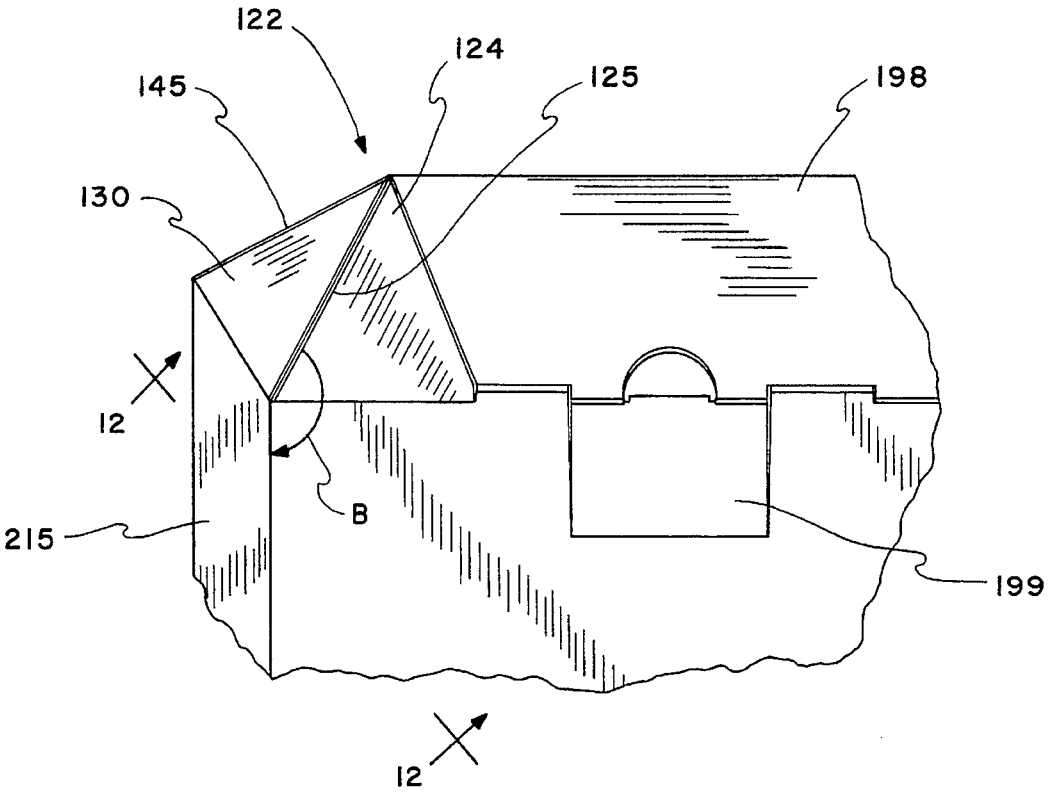
FIG. 13 is a partial perspective view of a top corner of the embodiment of FIG. 11.

After the triangle-shaped panels have been folded, third top panel 198 is folded downwardly along fold line 206 so that it overlays first top panel 124 in parallel relation to complete the peaked hip roof top for the box (FIG. 13). The final configuration of the box includes triangle-shaped panels 130 and 160 forming the hip roof gables, wherein each of said panels 130, 160 are flush with and not recessed under the peak, and panels 130, 160 are also flush with the entire longitudinal ends 125, 145 of first and second top panels 124 and 146, respectively (FIG. 13). Triangle-shape panels 130 and 160 are inwardly inclined relative to side panels 215, 213 respectively, at an angle between 90° and 180° . This inward inclination of the triangle-shaped panels acts as cam surfaces to guide the inventive box and objects on an airline baggage conveyor around each other. Although both of the two top corners are described herein, only one is pictured in FIG. 13 because they are mirror images of each other.

The inventive box secures clothes hung on hangers or within garment bags firmly within the box and protects them during travel. At the same time, the box is designed to avoid becoming caught on a baggage conveyor, because the top lacks any protruding handles, notches, flaps, or edges. Further, the box is reusable because the locking tabs are easily disengageable from the keeper slots. Thus, a garment bag can be removed from and later replaced in the box without destroying it. The box is easily transportable even when loaded with a garment bag due to the hand apertures in the rear panel.

Those who are skilled in the art will readily perceive how to modify the invention. Therefore, the appended claims are to be construed to cover all equivalent structures which fall within the true scope and spirit of the invention.

The invention claimed is:

1. A box for transporting clothes on hangers or in a garment bag of the type having a hanging hook, comprising:

front and rear panels, a pair of opposed side panels, and a bottom, said front, rear, and side panels and said bottom being joined to form a box;

a top assembly including a first and second top panels integral with and foldably joined to upper edges of said front and rear panels, respectively, said first and second top panels being foldable and coming together into a ridge peak extending over less than a full width of said box, said ridge peak being centered relative to said width of said box, a third panel integral with and foldably joined to said second panel, said third panel overlying said first panel, two sets of triangle-shaped panels forming a gable at each end of said peak, said gables being inclined panels beginning at an edge of said box and ending at opposite ends of said ridge peak, and means associated with each set of said gable forming triangle-shaped panels for lockably engaging the gable to the ridge peak thereby forming a hipped roof-like top on said box whereby said box was a somewhat elongated pyramidal shape, to reduce the probability that the box might snag on a baggage conveyor belt.

2. The box of claim 1 and at least two holes and a slot between said two holes, said holes and slots being formed in one of said first and second top panels for receiving a neck and an end of a hook, respectively, of a coat hanger with a curved portion of the hook located between the neck and hook end looping out of said slot over said one panel and back into one of said holes whereby both said neck and hook are inside said box with a looped top of said hook over an outside of said box.

3. The box of claim 1 wherein each of said engaging means is a pair of fastening tabs foldably joined to upper edges of two adjacent triangle-shaped panels.

4. The box of claim 1 wherein said engaging means extend along the inner surface of the gable.

5. A box for transporting clothes on hangers or in a garment bag having a hanging hook comprising:

a front and rear panel, a pair of opposed side panels, and a bottom, said front, rear, and side panels and said bottom being joined to form a box;

a hip roof-like top assembly on said box including first and second truncated triangular panels integral with and foldably joined to upper edges of said front and rear panels, respectively, said first and second panels being foldable to form inclined roof panels which meet and form a ridge peak having a length which is less than the length of said box, a third truncated triangular panel integral with and foldably joined to said second panel, said third panel overlying said first panel when said first and second panels meet at said ridge peak, and two triangle-shaped panels respectively being joined to upper edges of said opposed side panels, respective ones of said triangle shaped panels being located at and meeting each end of the ridge peak, said triangle-shaped panels being inclined from said side panels inwardly to said ridge to cooperate with said first and second panels in order to form a hip roof-like top having four inclined gables at opposite sides and at opposite ends of said box.

6. The box of claim 5 and means for lockably engaging said triangle-shaped panels to their respective ends of the hip roof peak.

7. The box of claim 6 wherein said engaging means are a pair of fastening tabs foldably connected to said triangle-shaped panels.

8. The box of claim 7 wherein said fastening tabs extend along the inner surface of the hip roof peak.

* * * * *